US008042471B2

(12) United States Patent
Michel et al.

(10) Patent No.: US 8,042,471 B2
(45) Date of Patent: Oct. 25, 2011

(54) SAFE AND ARM DEVICE AND EXPLOSIVE DEVICE INCORPORATING SAME

(75) Inventors: Matthew A. Michel, Bristow, VA (US); Joseph R. Mayersak, Ashburn, VA (US); Lance Benedict, McLean, VA (US)

(73) Assignee: Lockheed Martin Corporation, Bethesda, MD (US)

( * ) Notice: Subject to any disclaimer, the term of this patent is extended or adjusted under 35 U.S.C. 154(b) by 1363 days.

(21) Appl. No.: 11/066,924

(22) Filed: Feb. 28, 2005

(65) Prior Publication Data

US 2010/0031841 A1 Feb. 11, 2010

(51) Int. Cl.
*F42C 1/02* (2006.01)

(52) U.S. Cl. ..... 102/275; 102/216; 102/254

(58) Field of Classification Search ..... 102/221, 102/222, 223, 254, 256, 259, 230, 253, 266, 102/275, 216, 255, 272
See application file for complete search history.

(56) References Cited

U.S. PATENT DOCUMENTS

| | | | | | |
|---|---|---|---|---|---|
| 2,367,699 | A * | 1/1945 | Summerbell | ..... | 102/275 |
| 2,619,905 | A * | 12/1952 | Apotheloz | ..... | 102/222 |
| 2,870,713 | A * | 1/1959 | Puronto et al. | ..... | 102/251 |
| 3,945,324 | A * | 3/1976 | Popper et al. | ..... | 102/256 |
| 4,007,689 | A * | 2/1977 | Apotheloz | ..... | 102/251 |
| 4,242,964 | A * | 1/1981 | Warren et al. | ..... | 102/275 |
| 4,397,239 | A * | 8/1983 | Strobush | ..... | 102/275 |
| 4,466,351 | A * | 8/1984 | Strobush | ..... | 102/275 |
| 4,475,461 | A * | 10/1984 | Durrell | ..... | 102/200 |
| 4,782,757 | A * | 11/1988 | Carter | ..... | 102/394 |
| 5,198,615 | A * | 3/1993 | Robbie et al. | ..... | 102/476 |
| 5,309,843 | A * | 5/1994 | Rentzsch et al. | ..... | 102/476 |
| 6,378,435 | B1 * | 4/2002 | Bai et al. | ..... | 102/215 |
| 6,439,127 | B1 * | 8/2002 | Cherry | ..... | 102/519 |
| 6,540,175 | B1 | 4/2003 | Mayersak et al. | | |
| 6,604,467 | B2 * | 8/2003 | Alculumbre et al. | ..... | 102/249 |
| 6,748,842 | B1 * | 6/2004 | Guirguis | ..... | 89/1.13 |
| 2005/0066840 | A1 | 3/2005 | Michel | | |

OTHER PUBLICATIONS

Matthew A. Michel et al., U.S. Appl. No. 11/066,782, filed Feb. 28, 2005, entitled "Safe and Arm Device and Explosive Device Incorporating Safe and Arm Device".

* cited by examiner

*Primary Examiner* — Benjamin P Lee
(74) *Attorney, Agent, or Firm* — Buchanan Ingersoll & Rooney PC

(57) ABSTRACT

A safe and arm (S&A) device is disclosed. The device utilizes a no-fire separation distance and a mechanical configuration of primary explosive/booster explosive and secondary explosive to establish a safe mode. While in safe mode, the device would allow no more than 1 in 1 million detonation transfers to occur from primary to secondary. In armed mode, the no-fire separation distance is taken away, allowing reliable detonation transfer. Two arming environments, which occur after launch and safe separation, are used to move the S&A device to armed mode. The first environment is the release event of the projectiles from their packed state in a dispenser. The second environment is a target sense mechanism. If either arming environment returns to its original state, the mechanism returns to safe mode. The S&A device will not allow inadvertent packing into the dispenser of explosive devices in the armed state.

16 Claims, 11 Drawing Sheets

300
306
304
302
330
331
326
360
D
I'
320
322
336
324
332
312
310
d
342
X
Z 300
d
364
II'
322
328
338
336
324
332
370
370
d
342

300
322
338
336
324
332
342

SAFE AND ARM DEVICE AND EXPLOSIVE DEVICE INCORPORATING SAME

FIELD

The present disclosure relates generally to safe and arm devices for explosives.

BACKGROUND

Safe and Arm (S&A) devices are used to prevent an explosive device's main charge from inadvertently detonating, e.g., while stored or handled. These devices allow the explosive to detonate when desired or intended, e.g., when delivered to a target.

Two military specifications set forth standards that relate to fusing: Mil-Std-1316 for fuses; Mil-Std-1455 for dispensed projectiles and submunitions. These specifications include the following standards:

1. While in safe mode, the S&A device must not allow more than 1 in 1 million detonation transfers from primary to secondary explosive.
2. A submunition's S&A device should not allow packaging of the device in the dispenser in armed mode.
3. There must be two independent arming environments sensed by the S&A device that allow the device to go from safe mode to armed mode.
4. The two environments must occur after launch and after safe separation has occurred.
5. In the event the arming environments are taken back away, the S&A device must return to safe mode.
6. In armed mode, the S&A device should allow transfer from primary to secondary explosive if the explosive train is initiated. For further details, the interested reader is referred to the applicable standards, such as Mil-Std-1316 and Mil-Std-1455, the entire contents of which are incorporated herein by reference.

Three known types of S&A devices make use of sliders, rotors, and shutters. A physical barrier (e.g., metal) separates a primary explosive from a secondary explosive in an explosive device. These devices can take up more than three times the amount of space as the explosive material's transfer diameter. The transfer diameter is the minimum diameter needed in intimate contact between primary explosive and secondary explosive to achieve a reliable detonation transfer from primary explosive to secondary explosive. For example, the transfer diameter for typical explosives is 0.11 inches. A rotor that eccentrically turns a primary material to be inline with the secondary would need to be about 0.375 inches in diameter to swing a 0.125 inch diameter in line.

A set back and spin S&A device can be used in gun rounds. For example, an artillery gun round S&A can use set back as environment 1. The set back environment pulls a pin out of a plate mounted eccentrically on a shaft. Removal of the set back pin allows the plate to rotate about the shaft. The gun round is spun up by rifling in its barrel while the set back is present, so the eccentric plate can swing a primary in line with a secondary to arm the device.

An example of an artillery gun round fuse containing the S&A device is 2.5 inches in diameter. Unfortunately, if you scale down these S&A devices to a smaller diameter, they no longer work. The environments (accelerations) they use are still there, but the mass of the tiny pieces are so small they may not reliably overcome friction and springs to enable the armed condition. Also, the transfer diameter is scaled below a level where it will function reliably. The M758 fuse used with the 25 mm M242 gun is an example of an S&A device that works correctly for its specific size, but may not scale to operation at a smaller size.

SUMMARY

An exemplary safe-and-arm device is disclosed for an explosive device, and comprises a delay housing including a primary explosive or a booster explosive at an output end, the delay housing movable from a first position to a second position, wherein in the first position the primary explosive or the booster explosive is at a no-fire separation distance from a secondary explosive and in the second position the primary explosive or the booster explosive is at a distance less than the no-fire separation distance from the secondary explosive, a restraining element positioning the delay housing at the first position, the restraining element breakable under an applied force, and a target sensor protruding radially from an outer surface of the explosive device and connected to the delay housing to break the restraining element and to move the delay housing from the first position under a force applied to the target sensor.

An exemplary explosive device comprises a delay housing movable from a safe position to an arm position, a target sensor protruding from the explosive device and connected to move the delay housing from the safe position toward the arm position under an applied force, and a restraining element positioning the delay housing at the safe position, the restraining element breakable under the applied force.

An exemplary explosive train for an explosive device comprises a primer activated by contact with a firing pin, a delay housing movable from a safe position to an arm position, wherein the delay housing includes a deflagration-to-detonation material that is initiated by the activated primer, a target sensor protruding radially from the explosive device and connected to move the delay housing from the safe position toward the arm position under a force applied to the target sensor, and a secondary explosive, wherein the secondary explosive is detonated by the initiated delay housing.

An exemplary method to safe and arm an explosive device including a delay housing including a primary explosive or a booster explosive at an output end, a target sensor protruding from an outer surface of the explosive device and a safing channel in an outer surface of the explosive device, the safing channel adapted to receive a target sensor of an adjacent explosive device when the adjacent target sensor is in a first position, comprises safing the explosive device by a safing method including restraining the delay housing at the first position by a restraining element, wherein in the first position the primary explosive or the booster explosive is at a no-fire separation distance from a secondary explosive, and mating the target sensor to a safing channel in an adjacent explosive device.

BRIEF DESCRIPTION OF THE DRAWING FIGURES

The following detailed description of preferred embodiments can be read in connection with the accompanying drawings in which like numerals designate like elements and in which:

FIG. 1 schematically illustrates in the isometric perspective the overall projectile configuration for a projectile utilizing an exemplary embodiment of a S&A device.

Figures 9A, 9B, 9C:
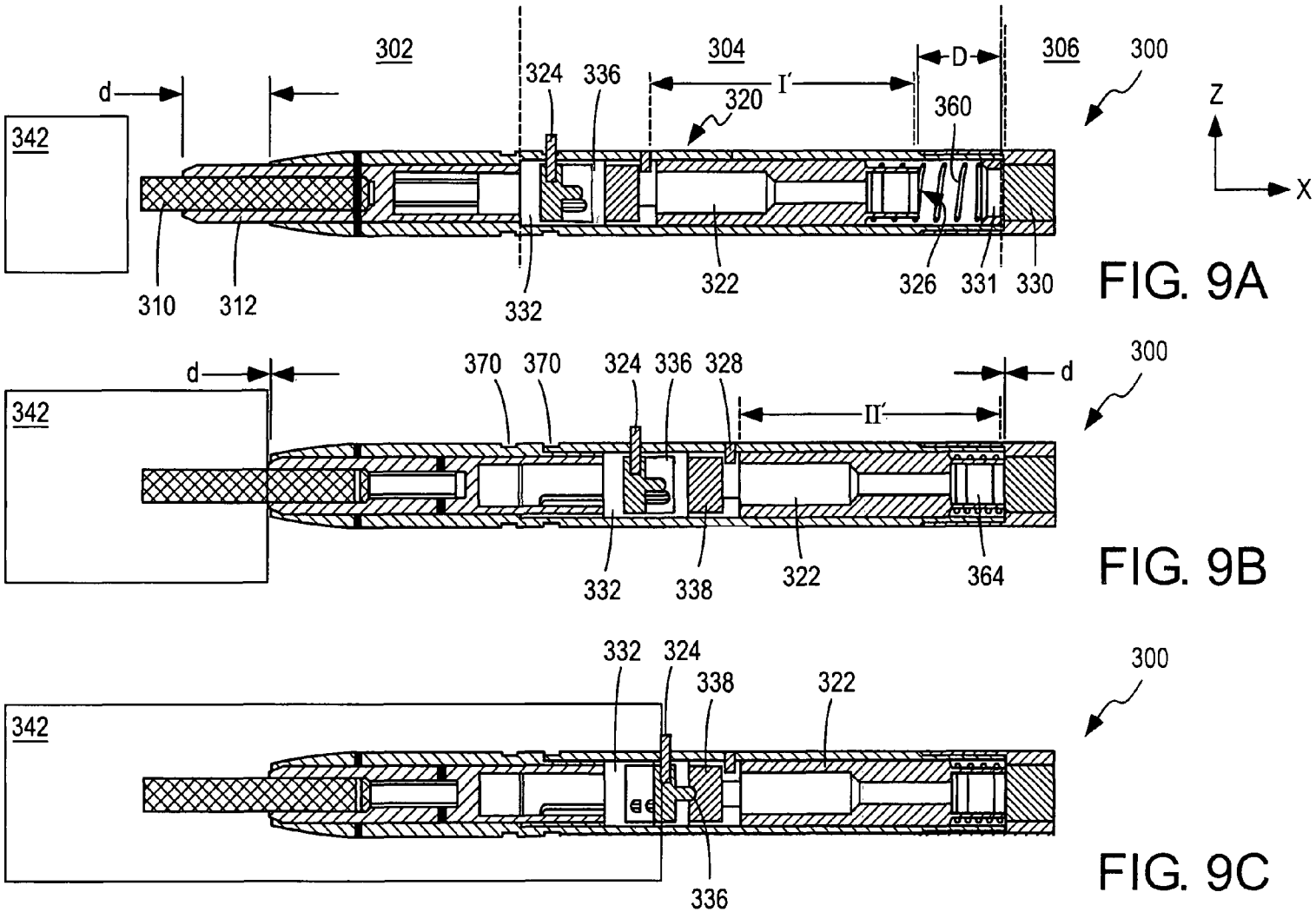
Figure 9D:
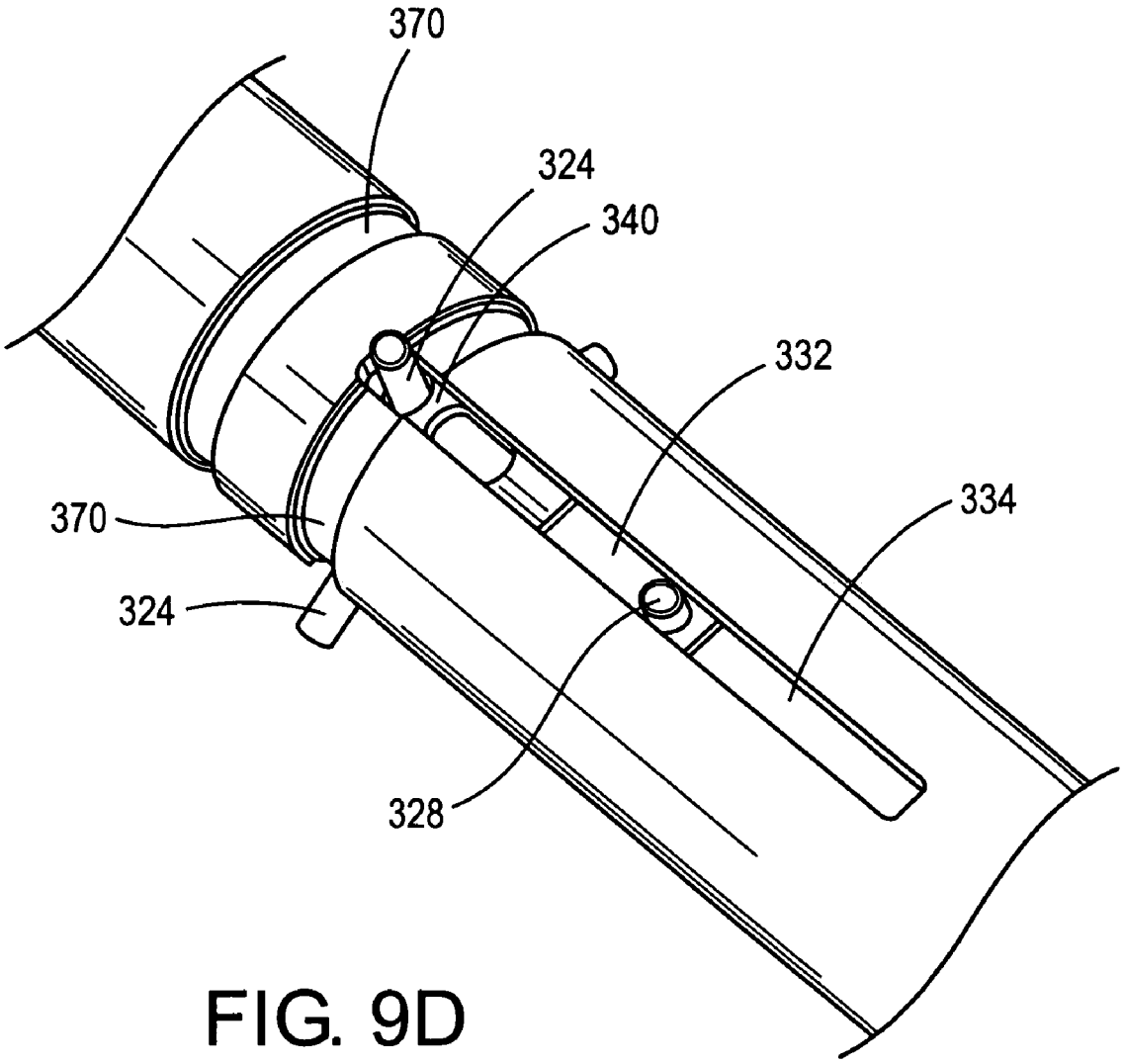

FIGS. 9A to 9D schematically illustrate, in sequence, an explosive device with an exemplary arm-then-fire sequence as it transfers from a safe mode (FIG. 9A) through initial contact with a target (FIG. 9B) to an armed mode (FIG. 9C). FIG. 9D is a top isometric view of the outside of the explosive device in the area of the S&A module.

DETAILED DESCRIPTION

Figure 1:
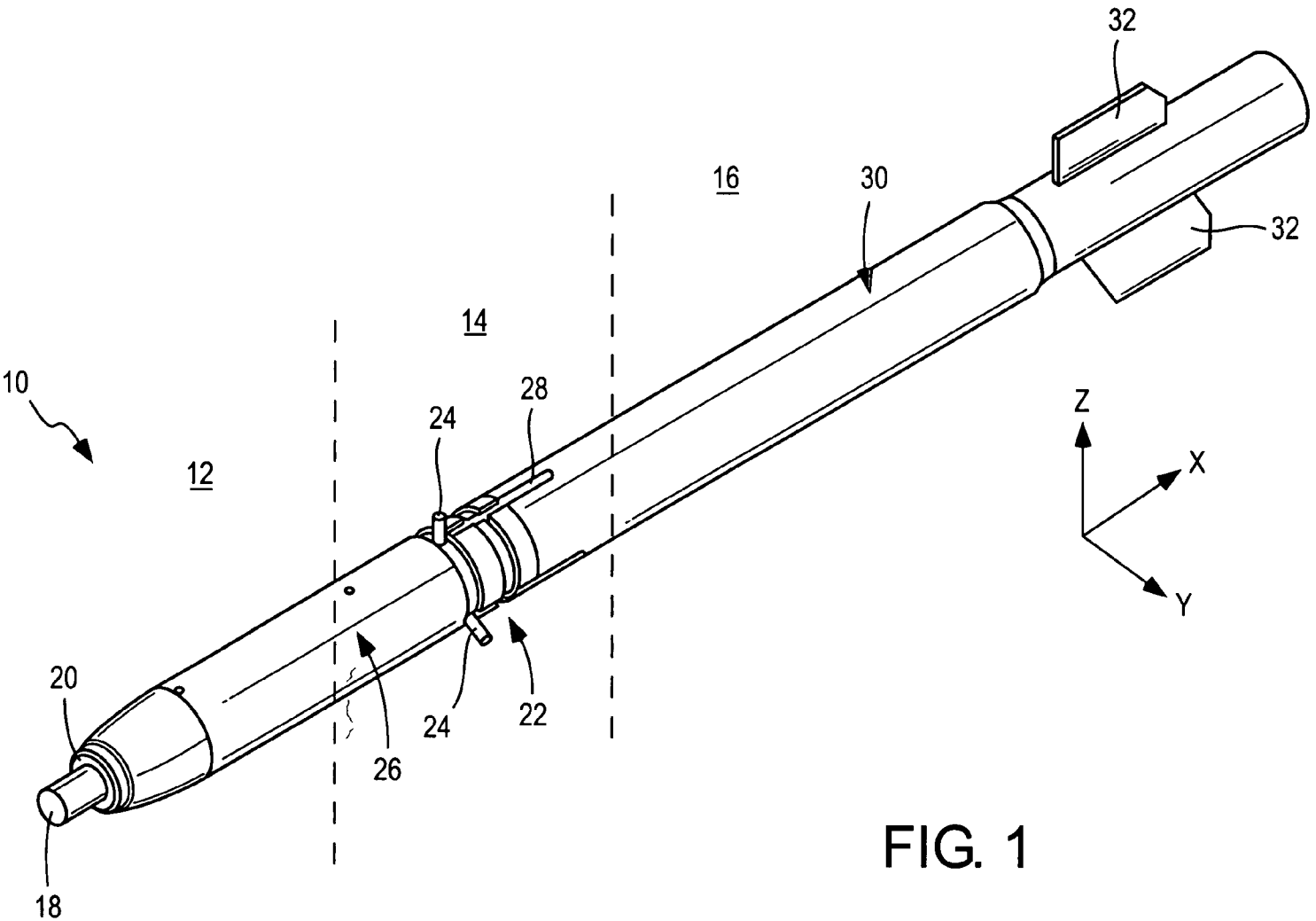

An exemplary embodiment of an explosive device with an exemplary embodiment of a S&A device is shown in FIG. 1. In FIG. 1 the explosive device is a projectile, but suitable explosive devices can include small caliber munitions, projectiles and submunitions. The explosive device 10 comprises three main modules—a nose module 12, a safe-and-arm module 14 and a tail module 16—exemplary approximate positions of which are shown in FIG. 1. The nose module 12 includes a trigger mechanism including a standoff pin 18 and trigger sleeve 20. The safe-and-arm module 14 fits inside and behind the nose module 12. Target sensing legs 24 associated with the S&A device 22 can be seen protruding from the outer surface 26 of the explosive device. The outer surface 26 in the area of, for example, the nose module 12 and S&A module 14, is slotted, e.g., with slot 28, to allow the target sensor 24 a path backwards and to serve as a stop once a certain travel is reached. Finally, the tail module 16 houses the payload (e.g., secondary explosive 34 shown in FIG. 2) in a dart tube 30. The tail module 16 also typically includes fins 32. The dart tube 30 and outer surface 26 can be mated together with a common male pilot and female receiver type bulkhead.

Figure 2:
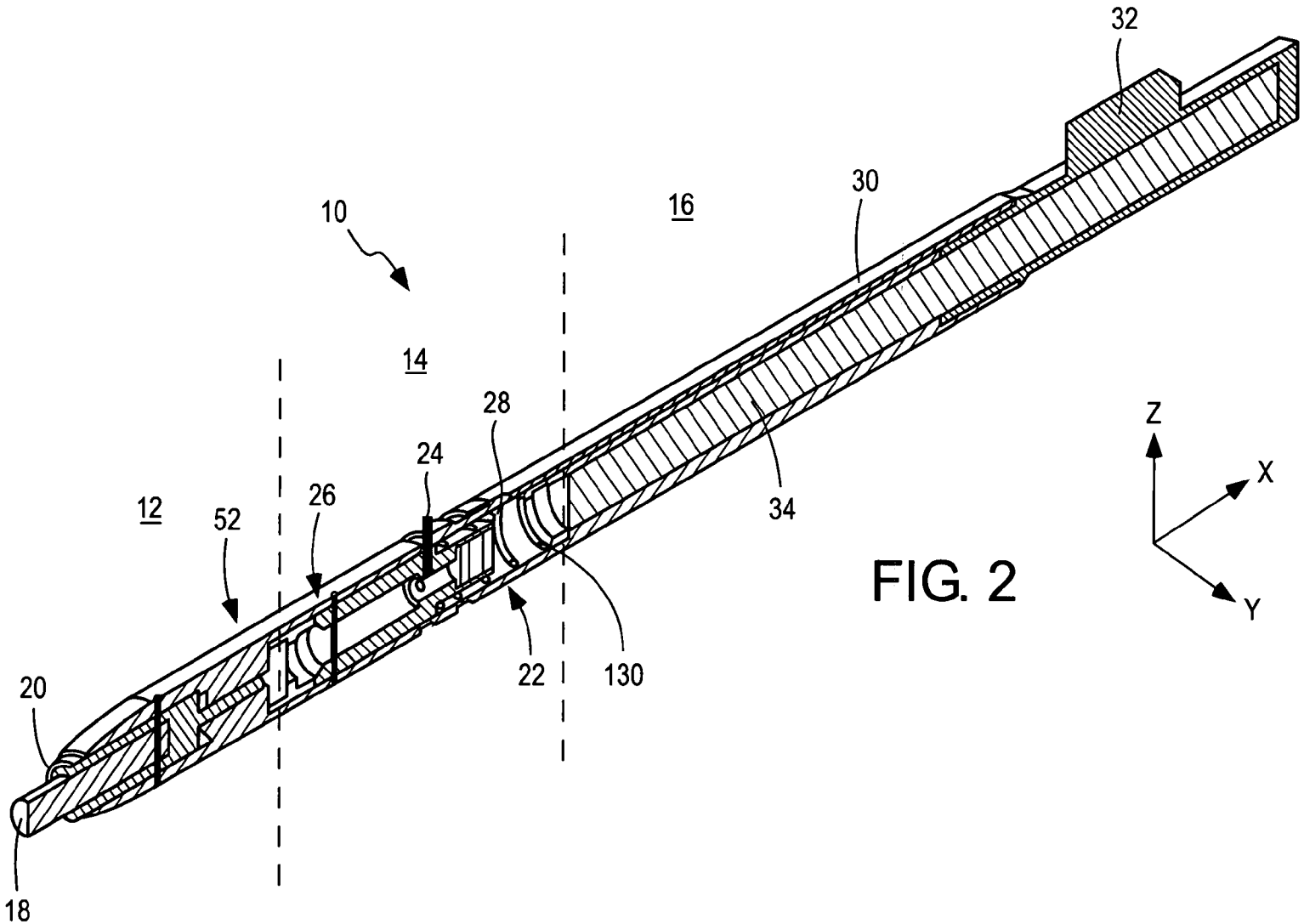
FIG. 2 is an isometric cross-sectional view of an exemplary embodiment of a projectile configuration with an exemplary embodiment of a S&A device.

Cutting the explosive device in half reveals the interior components of the explosive device, as shown in isometric cross-sectional view in FIG. 2. The FIG. 2 exemplary explosive device 10 includes an exemplary S&A device 22. The S&A device 22 is located between a trigger mechanism 52 and the secondary explosive 34.

Figure 3:
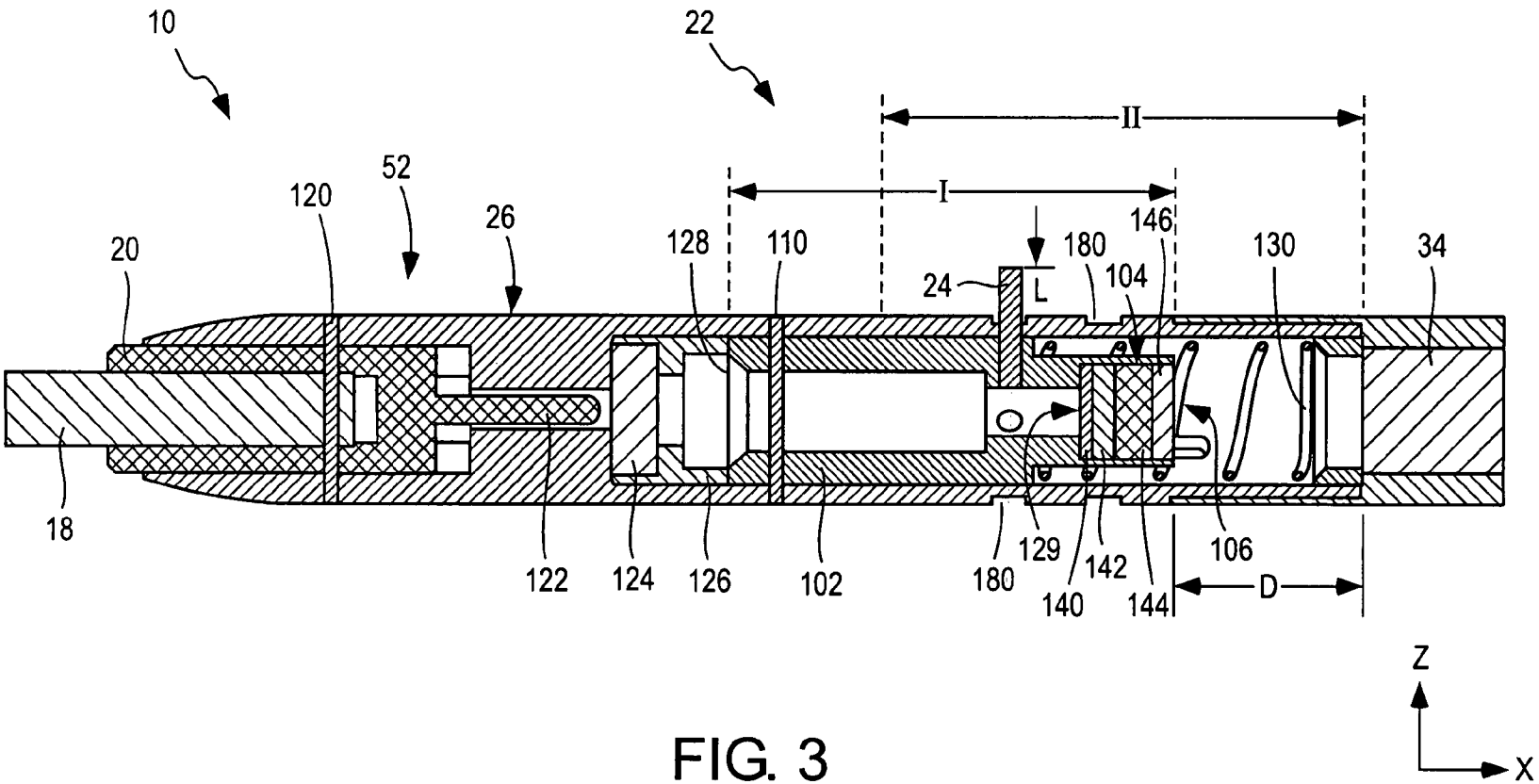
FIG. 3 is a side view in cross section of an exemplary embodiment of an explosive train while in safe mode.

The side view of the sectioned explosive device shows major components of the explosive device and an exemplary embodiment of a S&A device. FIG. 3 is a side view in cross section of an explosive train of a explosive device while in safe mode. An exemplary embodiment of a S&A device 22 comprises a delay housing 102 including a primary explosive and/or a booster explosive at an output end 106. As shown in FIG. 3, the primary explosive and/or a booster explosive 104 is a stacked multilayer explosive including both a primary explosive and/or booster explosive, but the primary explosive 104 can be arranged separate from the booster explosive. The delay housing 102 is movable from a first position I to a second position II (shown in FIG. 4 as the armed position). In the first position I, the primary explosive or the booster explosive is at a no-fire separation distance D from a secondary explosive 34. In the second position II (shown in an exemplary embodiment in FIG. 4), the primary explosive or the booster explosive is at a distance d from the secondary explosive 34 that is less than the no-fire separation distance D. The distance d does not have to be zero, e.g., the primary explosive or the booster explosive may, but is not required to, make intimate contact with the secondary explosive 34.

The exemplary embodiment of a S&A device 22 also comprises a restraining element 110, such as pin positioning the delay housing 102 at the first position I. The restraining element 110, such as for example a shear pin, is breakable under an applied force as discussed further below.

The exemplary embodiment of a S&A device also comprises a target sensor 24 protruding from the explosive device 10, either from the outer surface 26, the dart 30, or both. The target sensor 24 is connected to the delay housing 102 to break the restraining element 110 and to move the delay housing 102 from the first position I under a force applied to the target sensor 24. In exemplary embodiments, the target sensor 24 is a rod, bar or the like, but other suitable embodiments can include a bearing, a disk or portion of a disk or any other solid projection against which a force can be applied. Also, in exemplary embodiments, the target sensor 24 is protruding radially, but can also protrude off-axis or eccentrically. The target sensor 24 has material properties such that the restraining element 110 breaks allowing movement of the delay housing from the first position I before the target sensor 24 would break under the applied force. In operation, the target sensor 24 preferably does not break under the applied force, at least not until the delay housing has been moved to the second position II and the secondary explosive detonated.

The target sensor 24 can translate in any direction under the applied force such that it moves the delay housing 102 from the first position I toward the second position II. For example and as shown in, e.g., FIGS. 14, the target sensor 24 can be translated in a direction of motion that includes a first displacement component along an axial direction of the explosive device. Other directions of motion can be used, including one, two and three displacement component directions. An exemplary direction of motion has a first displacement component along an axial direction of the explosive device and a second displacement component along a radial direction of the explosive device, e.g., a slide or screw. As shown in FIGS. 1-4, the axial direction is the x-direction and the radial direction is one or more of the y-direction and z-direction.

Also shown in FIG. 3 is a triggering mechanism 52 including a standoff pin 18, sleeve 20, a sleeve shear pin 120, a firing pin 122 and a primer 124 housed in a stationary primer keeper 126. The function of these pieces is reviewed briefly here. The standoff pin 18 prevents the sleeve 20 from falsely triggering on objects other than an intended target. When an object, such as an intended target, is reached and contacted by the standoff pin 18, the sleeve 20 is pushed back with sufficient force to break the sleeve shear pin 120 and drive the firing pin 122 into the primer 124. The primer 124 outputs pressure and heat sufficient enough to ignite the first element of the primary explosive 104 of the delay housing 102. Exemplary embodiments of a standoff pin 18, sleeve 20 and firing pin 122 are described in U.S. Pat. No. 6,540,175 to Mayersak, the entire contents of which are herein incorporated by reference.

In exemplary embodiments, the primary explosive 104 is a stacked multilayer explosive including a primary material in the form of a deflagration-to-detonation material and a booster layer in the form of a keeper layer as an outermost layer. For example, exemplary embodiments include an injection moldable explosive as a keeper layer positioned as an outer layer of the stacked multilayer explosive. In another example, exemplary embodiments of the stacked multilayer explosive include PBXN-301 as an injection moldable explosive and DXN-1 as a deflagration-to-detonation material. A typical stacked multilayer explosive is shown in FIG. 3 and comprises a cushion disk 140, lead salt 142, DXN-1 primary (e.g., deflagration-to-detonation material) 144, and PBXN-301 keeper layer 146. The process of burning through the stacked multilayer explosive 104 in this exemplary embodiment is 300 μsec, but in general form any layering of materials to achieve a desired delay period can be utilized. In exemplary embodiments, the explosive train of the explosive device can include a primary explosive and/or a booster explosive, where the booster explosive is any explosive material that is positioned in the explosive train post-primary explosive and pre-secondary explosive. An example of a booster explosive is the keeper layer 146 of injection moldable explosive in the stacked multilayer explosive 104 shown in FIGS. 3 and 4. An example of a primary explosive is the DXN-1 primary (e.g., deflagration-to-detonation material) 144 in the stacked multilayer explosive 104 shown in FIGS. 3 and 4.

The deflagration-to-detonation material operates such that material on its input side (e.g., facing a primer) begins burning extremely fast but subsonic, called deflagration. By the time the burning wave front reaches the output side (e.g., facing a secondary explosive), the burning wave front achieves supersonic velocities, called detonation, and has the ability to detonate a secondary material in close proximity to it. Often times a deflagration-to-detonation material is referred to as a primary material (distinguished from a primer). The delay time is variable, determined by free volume and thickness of the slow burn delay material (such as but not limited to lead salt).

In an exemplary embodiment, pressure generated by the output gas of the primer 124 can contribute to the applied force to break the restraining element 110. Upon being struck by the firing pin 122, the primer 124 outputs heat and pressure. This pressure pushes against a surface 128 of the delay housing 102 and attempts to move the delay housing 102 from the first position I. This pressure also pushes against a surface 129 of the primary explosive 104 and tends to push the primary explosive 104 (or one or more layers of a stacked multilayer explosive) out of its position and into the no-fire separation distance D. To address this potential problem and to increase the reliability of the S&A device, a retainer that can withstand this pressure can be used in connection with the primary explosive. The retainer can be, as an example, a pressed-in metal washer or similar piece. An exemplary embodiment of a retainer is described in connection with a primary explosive that includes a stacked multilayer explosive. Metal aft of the primary 144 or injection moldable material 146 is not safe as these materials are powerful enough to create small metal shrapnel and accelerate them across the no-fire separation distance possibly detonating the secondary explosive 34 by impact. However, metal aft of the cushion disk 140 or aft of the delay material 142 but before the primary explosive 144 or booster explosive 146 is safe as these materials do not typically accelerate metal objects into the no-fire separation distance possibly detonating secondary explosive 34 by impact. As long as the stacked multilayer explosive 104 and its retainer take the pressure load, the primary explosive and/or booster explosive do not need retainers.

Figure 4:
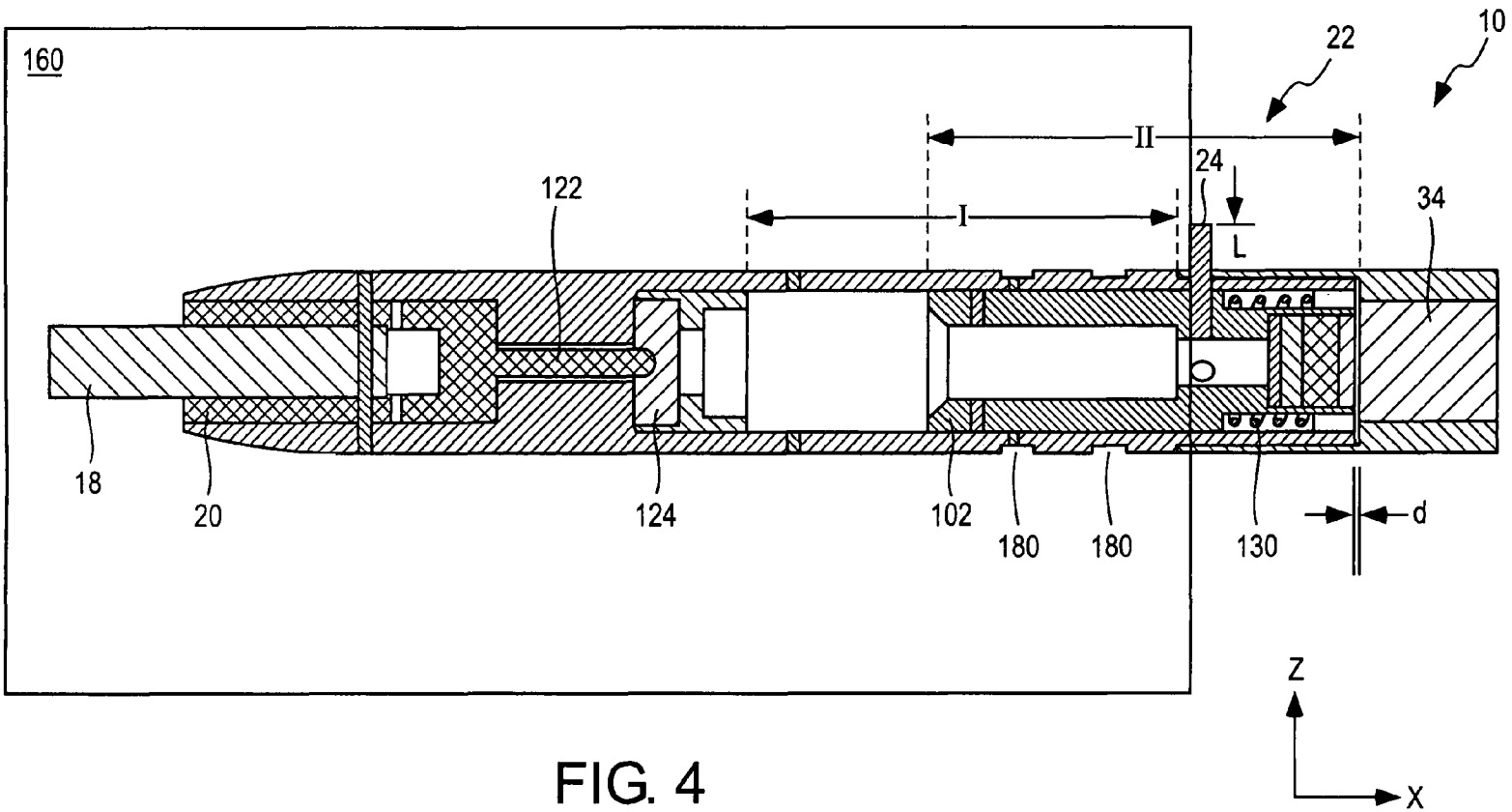
FIG. 4 is a side view in cross section of an exemplary embodiment of an explosive train in armed mode.

In an exemplary embodiment, the S&A device includes a stored energy device. The stored energy device is optional in the S&A device. FIGS. 2-4 illustrate an exemplary embodiment of a stored energy device 130. The stored energy device 130 biases the delay housing 102 toward the first position I. The stored energy device 130 can take any suitable form that biases the delay housing 102 toward the first position I, including but not limited to a spring, a bellows, a bladder, and a compressed gas. For example, in an exemplary embodiment the stored energy device 130 is a coil spring that biases the delay housing 102 toward the first position I by, for example, pressing against the delay housing 102 and against a stop at or near an interface of the secondary explosive 34. In another exemplary embodiment, the stored energy device 130 is a coil spring having one end circumscribing a perimeter of the delay housing 102. In another exemplary embodiment employing compressed gas as a stored energy device 130, the cavity forming the no-fire separation distance is substantially pressure tight, e.g., by use of o-rings at sliding surfaces. In exemplary embodiments, the force applied to the target sensor 24 can contribute to overcoming the biasing force of the stored energy device 130. Also in exemplary embodiments, the pressure generated by the output gas of the primer 124 can contribute to overcoming the biasing force of the stored energy device 130.

In an exemplary embodiment, the stored energy device can return the explosive device to the safe mode when the arming condition is removed. Here, for example, removal of the applied force to the target sensor 24 can result in the stored energy device 130 moving the delay housing 102 toward the first position I under the biasing force.

Figure 5B:
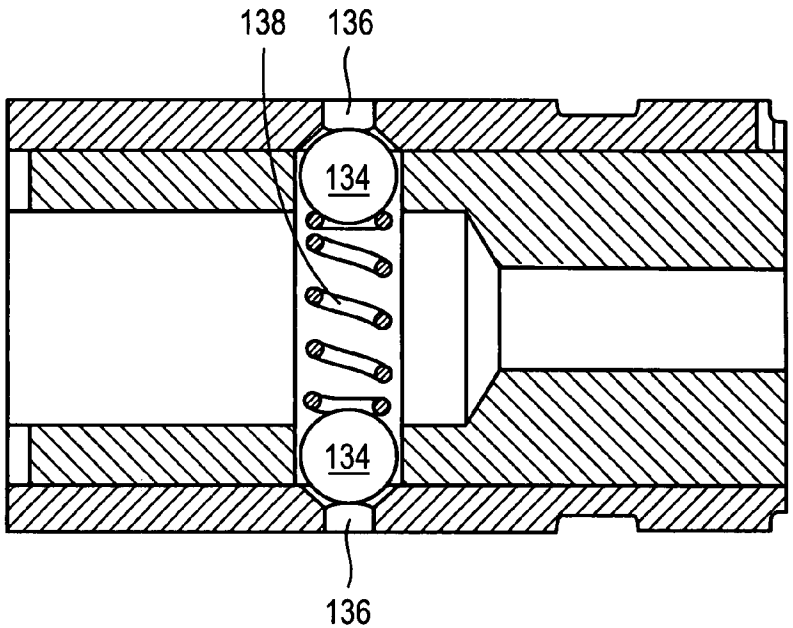
FIGS. 5A and 5B are schematic illustrations of an exemplary embodiment of an optional locking device incorporated into an exemplary embodiment of a S&A device.
Figure 5A:
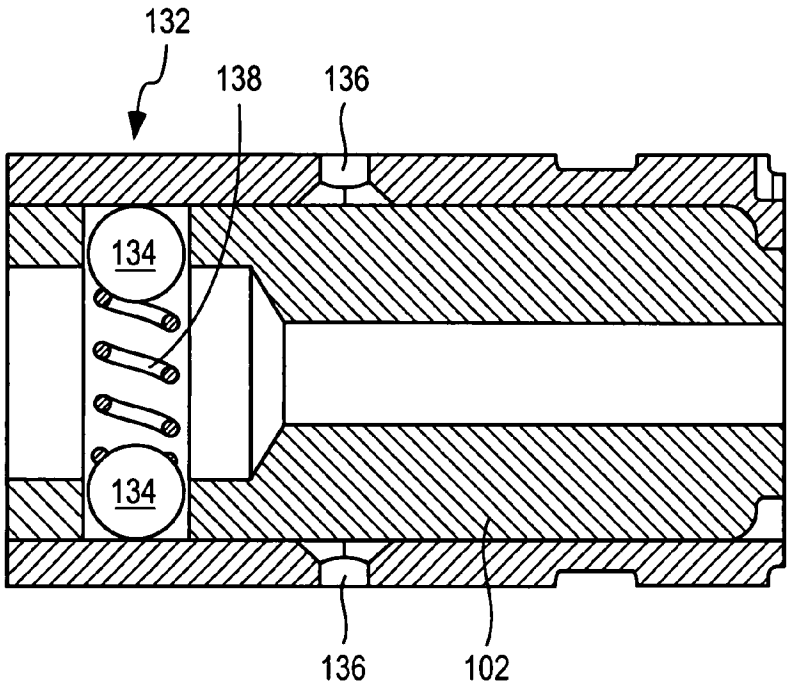

In an exemplary embodiment, an optional locking device can be included in the S&A device to lock the delay housing in an other than safe mode position, e.g., other than the first position I. For example and as shown in FIGS. 5A and 5B, the optional locking device 132 can include a radially-biased bearing 134 and a detent 136. The locking device 132 is incorporated into the safe-and-arm module of the explosive device. FIG. 5A shows the locking device when the explosive device is in a safe mode; FIG. 5B show the locking device when the explosive device is in an other than safe mode. In the example shown, the bearing 134 radially-biased by stored energy device such as spring 138 in a radial direction, is positioned in the delay housing 102. The detent 136 can be included at or near the second position II and is sized to cooperate with the bearing 134. In one example, the detent 136 is a reverse countersunk hole in the wall of the cavity containing the delay housing 102. When the delay housing 102 moves toward the second position II, the bearing 134 is biased into the detent 136, fixing the position of the delay housing 102 in the other than safe mode. This optional feature of the S&A device can be utilized in environments where it is desirable that removal of the arming condition does not return the explosive device to the safe mode.

In FIG. 3, the S&A device 22 is in safe mode. This means that Mil-Std-1316 is satisfied and the secondary explosive material cannot detonate or has a sufficiently low probability of detonation even if the rest of the explosive train fires and the primary explosive is initiated. As an example of this condition, picture the explosive device as shown in the safe mode shown in FIG. 3. If something were to hit the sleeve 20 and fire the primer 124, the secondary explosive 34 should not detonate. A secondary explosive does not normally detonate unless some other material, e.g., a primary explosive material, detonates it by going through its deflagration-to-detonation process in very close proximity. In exemplary embodiments, if other portions of the explosive train light off, ignite or detonate, no secondary explosive detonates. In a safe mode of the exemplary S&A device 22, the explosive device's secondary explosive 34 does not detonate if the primer 124 goes off because the no-fire separation distance D is too large to transfer across.

In exemplary embodiments, the no-fire separation distance D can be determined as follows. Consider the extremes of the separation distance between the primary explosive and/or the booster explosive and the surface of the secondary explosive when in safe mode. If the no-fire separation distance D were very large, say 100 feet in length, it is virtually impossible to transfer from the primary explosive/booster explosive to the secondary explosive. If the no-fire separation distance D were very small, say 0.002 inches, transfer from the primary explosive/booster explosive to the secondary explosive would occur quite reliably. Using the Intermediate Value Theorem in a broad sense, one can understand there must be some value for the no-fire separation distance at which transfer does not occur more often than 1 in 1 million times, which is the goal of the interrupter required by the specifications. It would not be practical to actually attempt to detonate 1 million explosive devices, but it is possible to determine the value of the no-fire separation distance by statistical methods. The process essentially starts with an arbitrarily determined value for the no-fire separation distance. It then shortens the no-fire separation distance until a transfer occasionally occurs. Once this threshold is known, the statistical system tests other values for the no-fire separation distance incrementally smaller and larger than the threshold no-fire separation distance and determines statistically what no-fire separation distance would result in 1 in 1 million transfers.

Using the above method to statistically determine a minimum distance between the primary explosive and/or the booster explosive and the secondary explosive to minimize transfer while in a safe mode, an exemplary embodiment of the no-fire separation distance is estimated to be about 0.030 to 0.25 inches, e.g., typical distances between primary explosives (such as but not limited to DXN-1)/booster explosives (such as but not limited to PBXN-301) and secondary explosives (such as but not limited to PBXN-5) across which the detonation event can be transferred is about 0.030 inches or less, alternatively about 0.025 inches or less. Further, in exemplary embodiments the distance less than the no-fire distance, e.g., distance d in FIG. 4, is a distance sufficient to transfer a signal from the output end, e.g., the primary explosive and/or the booster explosive of the stacked multilayer explosive, to the secondary explosive to initiate a reaction in the secondary explosive.

FIG. 4 is a side view in cross section of an exemplary explosive train. In FIG. 4, the S&A device 22 is in armed mode. The explosive device incorporating the S&A device is shown inside a target 160 to make clear how the sequence of events actually takes place. The trigger mechanism 52 for this explosive device is on its nose, so the primer 124 is actually fired before the explosive device is armed, e.g., a fire-then-arm device. This timing creates no conflict with the military safe and arm specifications, although it is unusual for the trigger event to happen before the arming event. Upon contact with the target 160, the trigger event drives the sleeve 20 backwards, causing the firing pin 122 to engage the primer 124. While the delay material of the delay housing 102 begins to burn through, the explosive device 10 continues to travel through the target 160. After the trigger event, the target sensor 24 contacts the target 160 and breaks the restraining element 110 positioning the delay housing 102 at the first position I, which allows the delay housing 102 to move toward the second position II, e.g., linearly aft along the longitudinal axis and reducing the no-fire separation distance D. In exemplary embodiments, the no-fire separation distance D is reduced to nothing and the primary explosive and/or the booster explosive is placed in intimate contact with the secondary explosive 34.

In a specific exemplary embodiment, the explosive device contacts the target and continues to travel through the target quickly (e.g., at 1000 ft/sec). For a 1.375 inch distance from retracted sleeve to fully moved target sensor and a no-fire distance of about 0.25 inches, the target sense legs hit the target at 94 μsec after the trigger event and break the pin holding the delay housing at position I, which allows the delay housing to move, e.g., move linearly aft along the projectile's longitudinal axis, toward position II. The no-fire separation distance has been reduced and the primary explosive and/or the booster explosive is in intimate contact with the secondary explosives after about 115 μsec. At the 300 μsec mark, the detonation in the primary explosive/booster explosive occurs and detonation is transferred to the secondary explosive.

To better understand the arming process, a discussion of both arming environments follows. Before moving to the armed mode, two arming environments are sensed by the S&A device.

The first environment is the dispense separation event, e.g., the dispensing and separation of a plurality of explosive devices. FIGS. 6A to 6D are conceptual illustrations of a first S&A environment showing how a plurality of explosive devices, e.g., submunition projectiles 202 in a dispenser 204 in the illustrated example, are in safe mode until the explosive devices are unpacked or released. Mil-Std-1455 indicates that submunitions in a dispenser can use the unpacking (releasing) of the submunitions as one of the arming environments. In this regard, an exemplary embodiment of the S&A device has a target sensor 24 where the length L of the target sensor 24 protruding from the outer surface of the explosive device is designed to sense the target 160 and also to serve as nesting pins in safing channels 180 in adjacent explosive devices when placed in the dispenser 204. The safing channels 180 can also be seen in FIGS. 3 and 4. The target sensors 24 are of sufficient protruding length to protrude toward the adjacent explosive device (in some exemplary embodiments, the target sensors 24 protrude toward all of the directly adjacent explosive devices). The safing channel 180 in the adjacent explosive device is used to hold the target sensor 24 in a position associated with a safe mode of the explosive device. As long as the target sensor 24 cannot move aft, the explosive device incorporating the exemplary S&A device is not in the armed mode. Note that three target sensors 24 are shown for each explosive device, but any number of target sensors 24 can be used. Also note that two safing channels 180 are shown for each explosive device, but any number can be used.

Figure 6D:
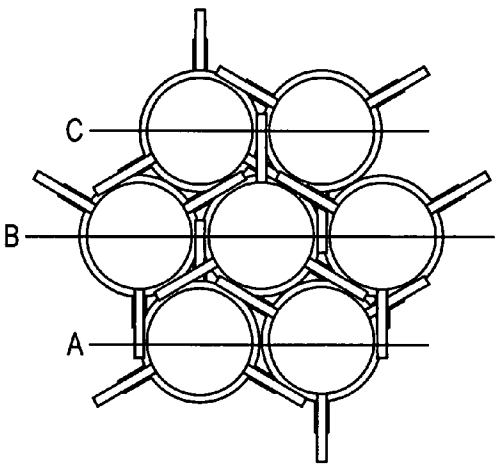
Figure 6C:
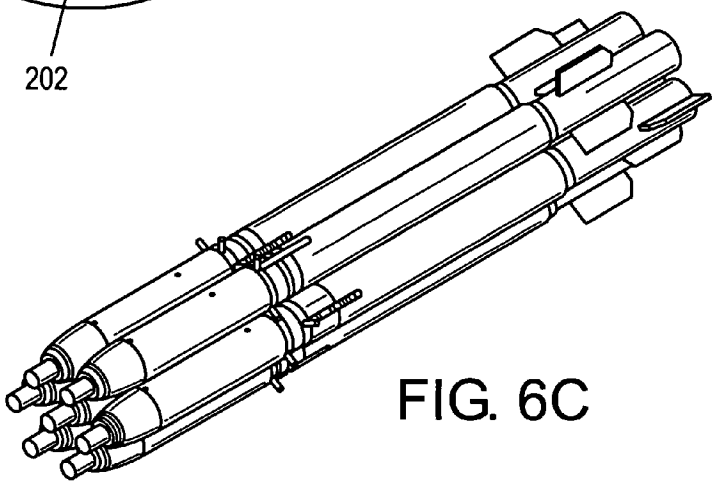
Figure 6A:
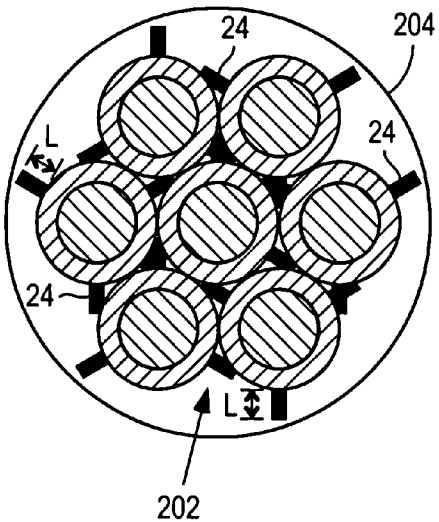
Figure 7A:
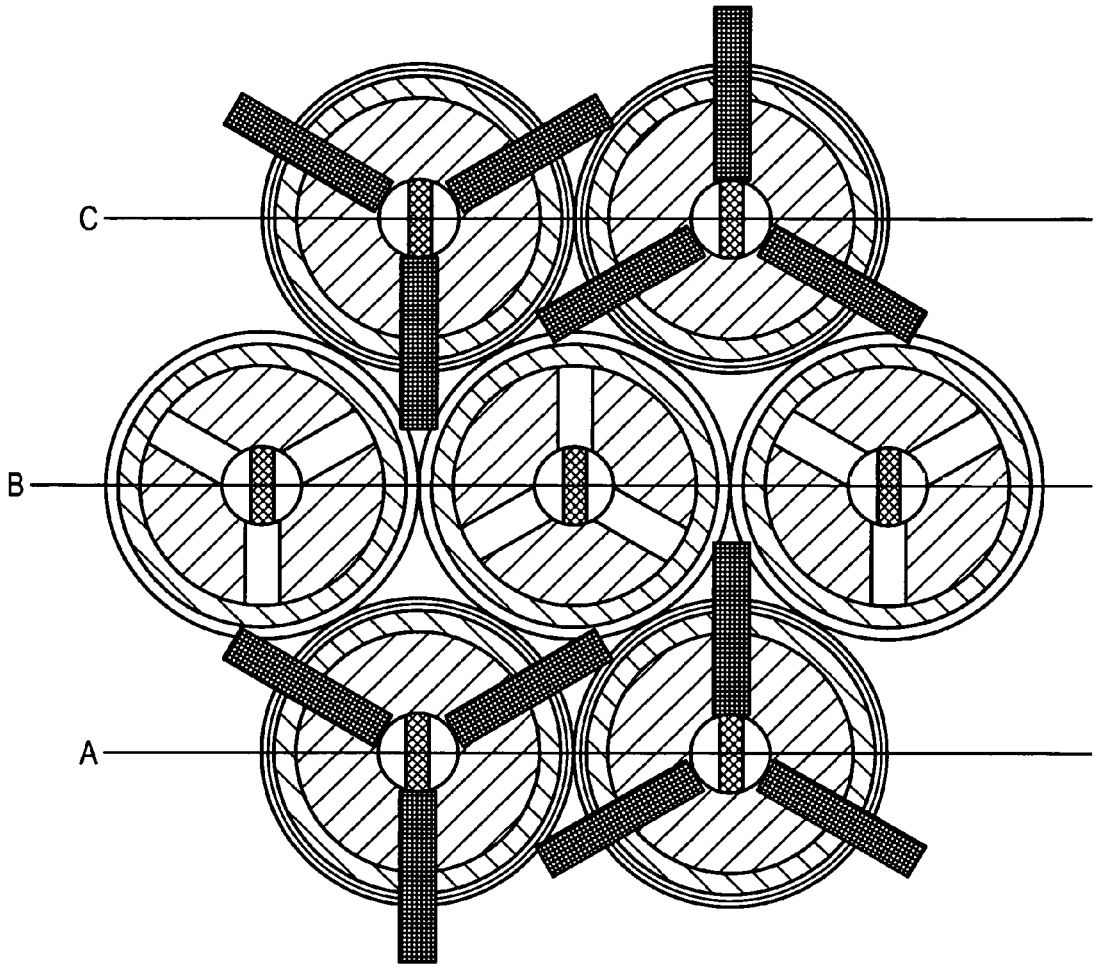
FIGS. 7A and 7B are schematic illustrations showing cross sections through a forward safing channel (FIG. 7A) and an aft safing channel (FIG. 7B).
Figure 7B:
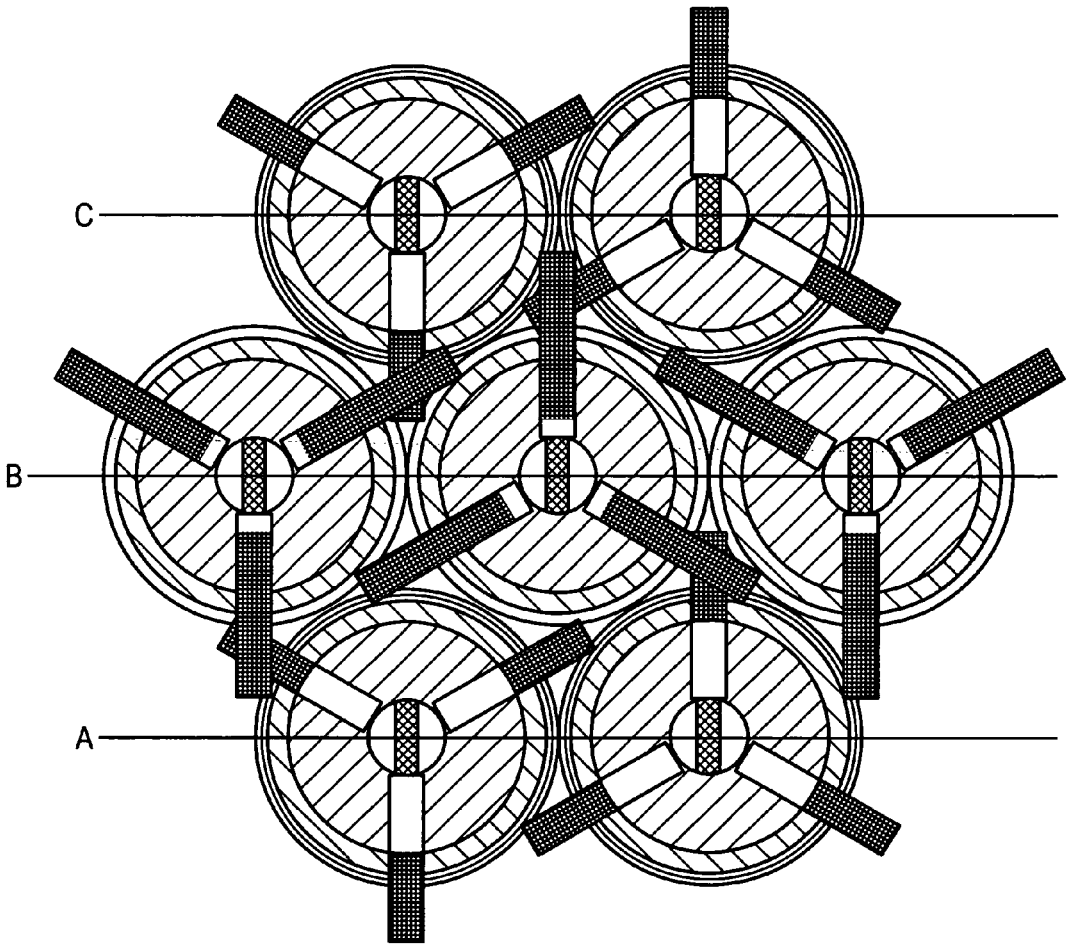

In an exemplary embodiment, the relationship between safing channels and target sensors and the operability of sating channels and target sensors when placed in a dispenser with other explosive devices having the exemplary S&A device can help to prevent and/or minimize errant packing of explosive devices in the dispenser if the exemplary S&A device is not in the safe mode, e.g, in the armed mode or at an intermediate condition between the safe mode and the armed mode. For example, a nesting pin and groove technique can be employed. In this exemplary technique, consider the plurality of explosive devices, e.g., submunition projectiles 202 in a dispenser 204 in the illustrated example, as being in adjacent rows as illustrated in FIG. 6D, where adjacent rows A, B and C are shown. The explosive devices in any one row have, when in the safe mode, target sensors in the same relative axial position, as shown in FIG. 6C. Further, the target sensors in any one row fit into a safing channel of explosive devices in one of the adjacent rows. For example, target sensors for explosive devices in Row B fit into safing channels of explosive devices in Row A and Row C. FIGS. 7A and 7B are schematic illustrations showing cross sections through a forward safing channel (FIG. 7A) and an aft safing channel (FIG. 7B) for a stacked plurality of explosive devices with Rows A, B and C indicated. The nesting pin and groove technique can be seen in these figures.

Figure 6B:
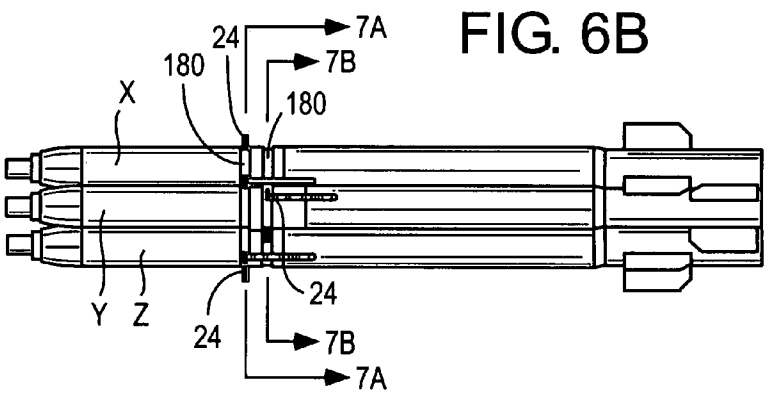
FIGS. 6A to 6D are conceptual illustrations of a first S&A environment showing how the submunition projectiles are in safe mode until the projectiles are unpacked or released.

One way to accommodate this nesting pin and groove technique is to position the safe-and-arm module 14 at a staggered position, as seen in FIG. 6B by the offset position of target sensor 24 of explosive device Y from the target sensor 24 of explosive devices X and Z. In the exemplary embodiment shown in FIGS. 6A to 6D, a staggered boat tail arrangement for the fins is used to allow for parallel positioning of the submuntions, although a staggered boat tail arrangement is not necessary for the nesting pin and groove technique. Details on the staggered boat tail arrangement can be found in U.S. patent application Ser. No. 10/671,066 entitled "System for Dispensing Projectiles and Submunitions" filed on Sep. 26, 2003, the entire contents of which are incorporated herein by reference.

Once the explosive devices are released and after safe separation has occurred, explosive devices move away from one another on the way to the target, at which time the target sensors 24 are free to move aft on contact with a target. If the arming environment is taken back away, the S&A device returns to safe mode. In this case, that can be interpreted as being packed back into the dispenser, and the S&A device would go back to safe mode if this occurred.

Figure 8:
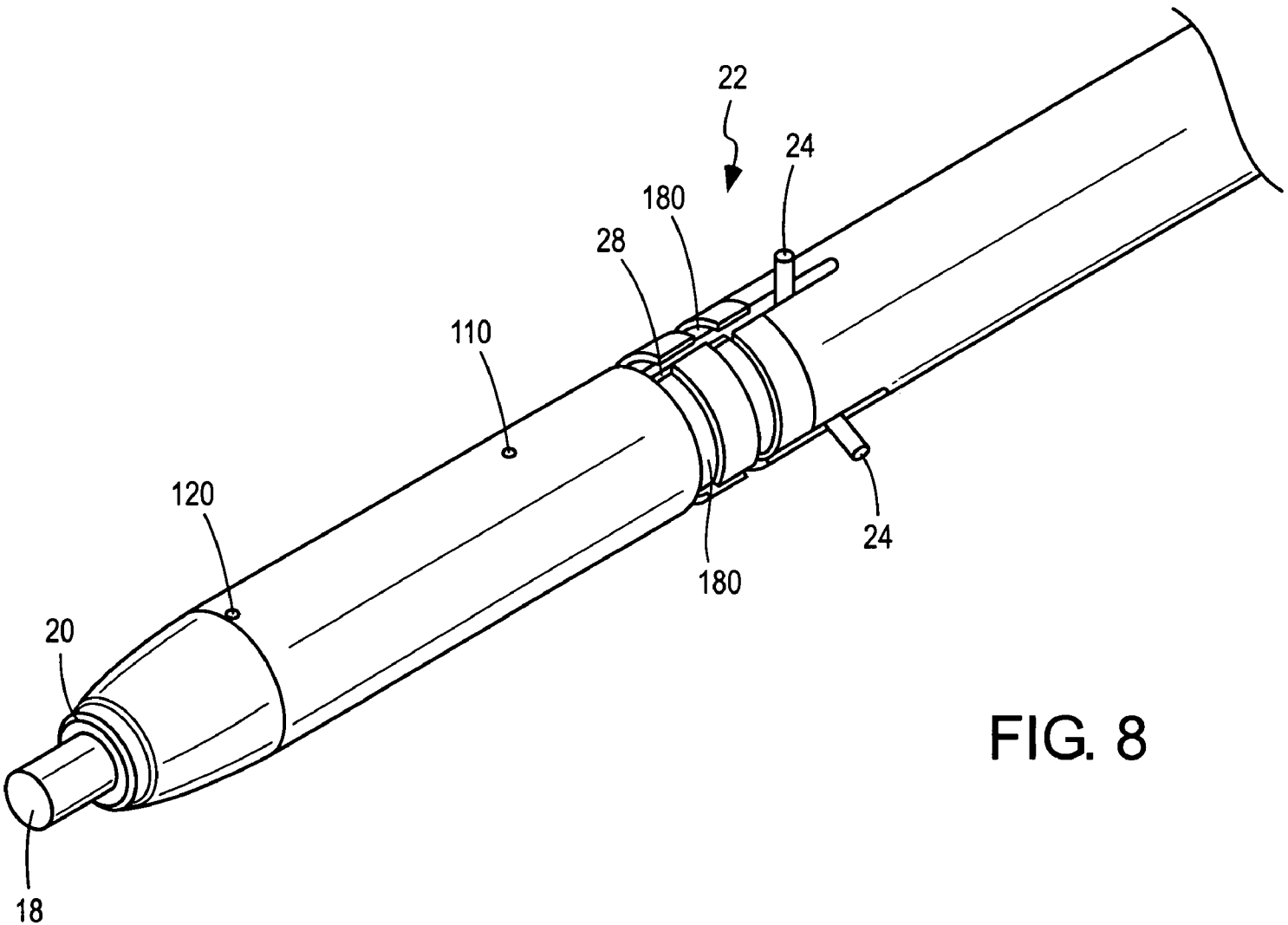
FIG. 8 is a schematic illustration of a second S&A environment showing the exemplary embodiment of a S&A device in a position correlated to an armed mode.

The second arming environment is target sense. FIGS. 4 and 8 show the target sense second arming environment. FIG. 4 shows an exemplary embodiment of an explosive device 10 in cross section in the second arming environment of target sense where a target 160 has contacted the target sensor 24 and moved the delay housing 102 from the first position I toward the second position II. FIG. 8 is a schematic illustration of the second S&A environment showing, in an isometric exterior view, the explosive device's S&A device 22 in a position correlated to an armed mode. In FIG. 8, the target sensors 24 have had a force applied upon contact with a target and the delay housing (not shown) has moved from the first position I toward the second position II. From an exterior of the explosive device, a visual indicator in the slot 28, such as a color, a strip, an alphanumeric or geometric symbol or a combination thereof, can provide an observer a visual indicator of the armed status. Likewise, in the safe position, a different visual indicator in the slot 28, such as a color a strip, an alphanumeric or geometric symbol or a combination thereof different form the armed visual indicator, can provide an observer a visual indication of the safe status.

In an exemplary embodiment of the disclosed S&A device, the mating primary and secondary surfaces maintain their integrity, e.g., packing and surface integrity, even under harsh freefall and vibrational environments. In general, explosives are pressed to close to 10,000 psi in an assembly and a flat face is generated at the future interfacing surfaces. A keeper layer, such as a cup, retainer, or foil keeper, can be used to prevent and/or minimize interface crumble and break down. It is not safe to have crumbled primary material or crumbled secondary explosive in and around moving parts. Typically, a layer of foil over the interface serves as a keeper layer. However, with a no-fire separation distance, such as an air gap, foil can be dangerous on the output end of the delay housing. Foil on the output end of the delay housing could be accelerated by the primary explosive across the no-fire separation distance at speeds sufficiently high enough to cause the secondary explosive to detonate on impact. The same problem could exist for screen or mesh employed as a keeper layer if they involve metal objects that could be created and accelerated. Exemplary embodiments of the S&A device can be tested in what is commonly called the "jumble" test, as outlined in Mil-Std-331 referenced from Mil-Std-1316, to evaluate the integrity of the primary and secondary surfaces under certain conditions. In this test, the S&A device is put in a wood lined box and turned at 30 rpm for 3600 revolutions to simulate harsh freefall and vibration environments. In the test, the explosive materials in the S&A device must not detonate during the test, but does not need to be functional after the jumble test.

To promote and enhance the integrity of the primary and secondary surfaces, the stacked multilayer explosive 104 utilizes, in exemplary embodiments, an injection moldable explosive (such as but not limited to PBXN-301) as a keeper layer. This explosive has a putty-like or formable plastic-like consistency. It is sometimes described as "explosive silicone". A thin layer of PBXN-301 could be used to keep the primary material in place. This keeper layer of injection moldable explosive then ultimately transfers to the secondary explosive. On the secondary explosive side, standard explosive manufacturing processes can be used to put a foil keeper on the interface. In this example, only the stacked multilayer explosive 104 has potential of creating accelerated masses, so a foil cover is fine for the secondary explosive. The injection moldable explosive can easily transfer through a keeper layer covering the secondary explosive as long as the transfer faces are substantially intimate, meaning within 0.030 inches.

In an exemplary embodiment, a fire-then-arm sequence is used in which the explosive device is fired, e.g., ignition of the primary is started, and then the explosive device is armed, e.g., the S&A device is placed in the armed condition. An exemplary explosive device employing a fire-then-arm sequence can choose an appropriate delay, such as e.g., 300 μsec, to allow the bulk of the explosive device payload to enter the target before it detonates, but any desired delay time can be utilized. The exemplary arrangements in FIGS. 2-4 are examples of explosive devices with a fire-then-arm sequence in which the trigger sleeve is the firing mechanism and the target sensors are the arming mechanism.

Other exemplary embodiments can use an arm-then-fire sequence in which the explosive device is armed, e.g., the S&A device is placed in the armed condition and then the explosive device is fired, e.g., ignition of the primary explosive is started. An arm-then-fire sequence can be useful when minimum delay is desired between a triggering event and actual detonation of the explosive device. Exemplary embodiments of an arm-then-fire system would be useful when an explosive device needing no delay at all is used. In such an exemplary embodiment, the deflagration-to detonation material, e.g., DXN-1 and keeper layer, e.g., PBXN-301, could be right behind the primer and the exemplary embodiment can eliminate the free volume, cushion disk and lead salt from the explosive train.

FIGS. 9A to 9C schematically illustrate, in sequence, an exemplary embodiment of an explosive device with an exemplary embodiment of a S&A device as it transfers from a safe mode (FIG. 9A) through initial contact with a target (FIG. 9B) to an armed mode (FIG. 9C). In this exemplary embodiment, the explosive device follows an arm-then-fire sequence in which the arming sleeve is the arming mechanism and the target sensors are the firing mechanism.

In FIGS. 9A to 9C, the explosive device 300 comprises three modules—a nose module 302, a safe-and-arm module 304 and a tail module 306. The nose module 302 includes an arming mechanism including a standoff pin 310 and arming sleeve 312. The safe-and-arm module 304 includes an exemplary embodiment of a S&A device 320. The tail module 306

(only partially shown in these figures) includes a payload, such as a secondary explosive 330.

The S&A device 320 has some features consistent with embodiments described herein. Exemplary embodiments include a delay housing 322 that is movable from first position I' toward a second position II'. In the first position I', a primary explosive or booster explosive is at an output end 326 of the delay housing 322 and is separated from the secondary explosive 330 by a no-fire separation distance D. In the second position II', the separation distance between the primary explosive and/or the booster explosive and the secondary explosive 330 is less than the no-fire separation distance D. Other features, similar to those described herein with respect to FIGS. 1-8, can also be included in similar or modified forms.

In contrast to the fire-then-arm embodiments, the exemplary embodiments shown in FIGS. 9A to 9C illustrate that the arming mechanism in the nose module 302 moves the delay housing 322 from the first position I' toward the second position II'. This first motion is arrested by contact of a stop pin 328 with an end of slot 334. A stop keeps the momentum from carrying the delay housing 322 into the secondary explosive 330. Any suitable stop can be used, such as the illustrated stop pin or a shelf in a stiffening funnel 331 or similar common device. The first motion also moves the target sensor 324 and transfer sleeve 332. Note in this first motion that there is substantially no relative motion between firing pin 336 and primer 338. After moving the delay housing 322 toward second position II', the explosive device 300 is armed and the primary explosive and/or the booster explosive is facing the secondary explosive 330 across a distance d less than the no-fire separation distance, preferably in intimate contact.

When an optional stored energy device 360 is present, the force applied to move the delay housing 322 overcomes the optional stored energy device 360. As shown in FIG. 9B, at full movement of the arming sleeve 312 the delay housing 322 has also moved to place the primary explosive and/or the booster explosive in substantially intimate contact with the secondary explosive 330. In this position, the explosive device 300 has been armed, but has not yet been fired.

FIG. 9D is a top isometric view of the outside of the explosive device 300 in the area of the S&A module 304. Shown in FIG. 9D are target sensor 324, transfer sleeve 332, stop 328 and slot 334 prior to the first motion discussed above. These features move a portion of the length of slot 334 by the arming mechanism. Also shown in FIG. 9D is target sensor 324 restrained by a restraining element 340. The restraining element 340 can be any suitable restraining element, such as a shear wall, that breaks by contact between the target sensor 324 and a target 342.

In the exemplary embodiment shown in FIG. 9C, the explosive device 300 has penetrated further into the target 342. The target sensor 324 has contacted the target 342 generating an applied force to move the target sensor 324 in a second motion after breaking the restraining element 340 further in an axial direction, e.g., in a direction with at least an x-axis component. As the target sensor 324 moves, a firing pin 336 also moves until it contacts the primer 338, initiating reaction of an explosive stacked multilayer 364 including the primary explosive and/or the booster explosive and detonating the secondary explosive 330. Thus, in the exemplary fire-then-arm embodiments shown in FIGS. 9A to 9D, movement of the target sensor 324 initiates the explosive train by moving a firing pin 336 into a primer 338.

Also shown in FIGS. 9A-9D are safing channels 370, similar to those described herein in connection with FIGS. 1-8.

The S&A device described herein is practical at any size scale, including down to small diameters, e.g., less than 1 inch diameters, .35 (0.35 mm) caliber, preferably .25 (0.25 inches) caliber. In addition, the disclosed S&A device can be used in other size explosive devices, such as .44 caliber and .50 caliber munitions.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. An explosive device, comprising: a casing; a delay housing movable from a safe position to an arm position; a target sensor protruding radially through the casing of the explosive device and connected to move the delay housing from the safe position toward the arm position under an applied force; and a restraining element positioning the delay housing at the safe position, the restraining element breakable under the applied force.

2. The explosive device of claim 1, comprising a stored energy device biasing the delay housing toward the safe position.

3. The explosive device of claim 2, wherein the stored energy device is one or more of a spring, a bellows, a bladder, and a compressed gas.

4. The explosive device of claim 1, wherein the delay housing includes a primary explosive or a booster explosive and wherein in the safe position, the primary explosive or the booster explosive is separated from secondary explosive by a no-fire separation distance and wherein in the arm position, the primary explosive or the booster explosive is separated from the secondary explosive by a distance less than the no-fire separation distance.

5. The explosive device of claim 4, wherein the no-fire separation distance is a statistically determined minimum distance between the primary explosive or booster explosive and the secondary explosive to minimize transfer from the primary explosive or from the booster explosive to the secondary explosive while in a safe mode.

6. The explosive device of claim 4, wherein the booster explosive is an outer layer of a stacked multilayer explosive and is an injection moldable explosive.

7. The explosive device of claim 6, wherein the injection moldable explosive is PBXN-301.

8. The explosive device of claim 1, wherein a direction of motion of the target sensor under the applied force includes a first displacement component along an axial direction of the explosive device.

9. The explosive device of claim 1, comprising:

a primary explosive or a booster explosive; and a secondary explosive, wherein a force of an ignition of the primary explosive or the booster explosive is configured to detonate the secondary explosive when the delay housing is in the armed position and configured to not detonate the secondary explosive when the delay housing is in the safe position.

10. An explosive device, comprising:

a delay housing movable from a safe position to an arm position;

a target sensor protruding from the explosive device and connected to move the delay housing from the safe position toward the arm position under an applied force; and a restraining element positioning the delay housing at the safe position, the restraining element breakable under the applied force;

wherein a direction of motion of the target sensor under the applied force includes a first displacement component along an axial direction of the explosive device; and wherein the direction of motion includes a second displacement component along a radial direction of the explosive device.

11. An explosive device, comprising:

a delay housing movable from a safe position to an arm position;

a target sensor protruding from the explosive device and connected to move the delay housing from the safe position toward the arm position under an applied force;

a restraining element positioning the delay housing at the safe position, the restraining element breakable under the applied force; and a safing channel in an outer surface of the explosive device, the safing channel adapted to receive a target sensor of an adjacent explosive device when the delay housing of the adjacent explosive device is in the first position.

12. An explosive train for an explosive device, including a casing comprising:

a primer activated by contact with a firing pin;

a delay housing movable from a safe position to an arm position, wherein the delay housing includes a deflagration-to-detonation material that is initiated by the activated primer;

a target sensor protruding radially through the casing of the explosive device and connected to move the delay housing from the safe position toward the arm position under a force applied to the target sensor; and a secondary explosive, wherein the secondary explosive is detonated by the initiated delay housing.

13. The explosive train of claim 12, comprising a stored energy device biasing the delay housing toward the safe position.

14. The explosive train of claim 12, comprising a restraining element positioning the delay housing at the safe position, the restraining element breakable under the force applied to the target sensor, wherein in the safe position, the deflagration-to-detonation material is separated from the secondary explosive by a no-fire separation distance, and wherein in the arm position, the deflagration-to-detonation material is separated from the secondary explosive by a distance less than the no-fire separation distance.

15. The explosive train of claim 14, wherein the no-fire separation distance is a statistically determined minimum distance between the deflagration-to-detonation material and the secondary explosive to minimize transfer from the deflagration-to-detonation material to the secondary explosive while in a safe mode.

16. An explosive device, comprising:

a casing;

a delay housing movable from a safe position to an arm position;

a target sensor protruding through the casing of the explosive device and connected to move the delay housing from the safe position toward the arm position under an applied force;

a restraining element positioning the delay housing at the safe position, the restraining element breakable under the applied force;

a nose protruding trigger mechanism including a primary explosive or a booster explosive; and a secondary explosive, wherein the trigger mechanism is separate from the target sensor and configured to ignite the primary explosive or the booster explosive, and wherein the force of the ignition of the primary explosive or the booster explosive is configured to detonate the secondary explosive when the delay housing is in the armed position and configured to not detonate the secondary explosive when the delay housing is in the safe position.

* * * * *